US006443357B1

(12) United States Patent
Marbe et al.

(10) Patent No.: US 6,443,357 B1
(45) **Date of Patent: *Sep. 3, 2002**

(54) PACKAGING CASE AND PACKAGING MATERIAL THEREFOR

(75) Inventors: Peter Marbe, Lomma (SE); Patrik Hylta, Modena (IT)

(73) Assignee: Tetra Laval Holdings & Finance, S.A. (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/530,321

(22) PCT Filed: Nov. 19, 1998

(86) PCT No.: PCT/JP98/05222

§ 371 (c)(1),
(2), (4) Date: Apr. 28, 2000

(87) PCT Pub. No.: WO99/25620

PCT Pub. Date: May 27, 1999

(30) Foreign Application Priority Data

Nov. 19, 1997 (JP) ..... 9-318579

(51) Int. Cl.[7] ..... B65D 5/08

(52) U.S. Cl. ..... 229/137; 229/140; 229/125.19; 229/216; 229/110; 229/119; 229/113

(58) Field of Search ..... 229/137, 109, 229/110, 138, 132, 125.19, 216, 217, 140, 125.25

(56) References Cited

U.S. PATENT DOCUMENTS 3,650,458 A * 3/1972 Rausing ..... 229/125.15
4,185,765 A * 1/1980 McLaren ..... 229/137 X
4,267,957 A * 5/1981 Holmstrom ..... 229/137
4,362,245 A * 12/1982 Kuchenbecker ..... 229/215 X
4,520,957 A * 6/1985 Lisiecki ..... 229/137
4,546,884 A * 10/1985 Kuchenbecker ..... 229/216
5,118,036 A * 6/1992 Mandersson ..... 229/216 X
5,531,375 A * 7/1996 Palm ..... 229/137
5,871,144 A * 2/1999 Anchor et al. ..... 229/109
5,938,107 A * 8/1999 Anchor et al. ..... 229/109

FOREIGN PATENT DOCUMENTS

JP 9-99936 * 4/1997

* cited by examiner

*Primary Examiner*—Lee Young
*Assistant Examiner*—Tri M. Mai
(74) *Attorney, Agent, or Firm*—Lorusso & Loud

(57) ABSTRACT

An object is to secure a sufficient area for bonding a spout open/close member (51). A packaging container has a pair of seal portions; at least five side-surface panel portions (27) for forming a circumferential wall; an end-surface panel portion (35) disposed between the seal portion and the side-surface panel portions (27) and adapted to form a polygonal end-surface portion in cooperation with an intermediate portion **(15*a*) of the seal portion; and flap portions (31) projected, together with end portions (15*b*) of the seal portion, from the end-surface panel portion (35), each of the flap portions (31) being bent toward a specified panel portion (27*a*) among the side-surface panel portions (27) and being welded to the specified panel portion (27*a*). In this case, since the flap portions (31) are welded to the specified panel portions (27*a*)**, and the end-surface portion is thus made substantially flat, a sufficiently large flat area can be secured on the end-surface portion.

12 Claims, 8 Drawing Sheets

PACKAGING CASE AND PACKAGING MATERIAL THEREFOR

TECHNICAL FIELD

The present invention relates to a packaging container and packaging material therefor.

BACKGROUND ART

Conventionally, in order to reduce the weight and cost, a packaging container containing liquid food (contents) such as milk or soft drink is manufactured from a packaging material including a paper substrate and resin layers formed so as to sandwich the paper substrate.

A method of manufacturing such packaging containers comprises a first step of forming a semi-finished package as an intermediate product, and a second step of forming a final package.

In the first step, a sheet-shaped packaging material is transported longitudinally and the opposite transverse edges of the packaging material are sealed together in the longitudinal direction (longitudinal sealing) so as to form the packaging material into a tubular shape, and liquid food is charged therein. Subsequently, the tubular packaging material is sealed in a transverse direction (transverse sealing) at predetermined intervals in order to form strip-shaped sealed portions, and is then cut at the sealed portions. Thus is formed a pillow-shaped, semi-finished package that contains liquid food and has a predetermined thickness.

In the second step, the semi-finished package is formed into a polygonal columnar shape such as a hexagonal prism or an octagonal prism, and a pair of flaps are formed at either end of the semi-finished package. Subsequently, the flaps at either end are folded so as to face each other and welded to the corresponding end-surface portion to complete the final package (see Japanese Patent Application Laid-Open (kokai) No. 7-187181).

A rupturable portion is formed in advance in the upper end-surface portion of the final package. The rupturable portion is easily ruptured upon receipt of an external force. Further, a spout open/close member formed of a resin is bonded to the final package at a position corresponding to the rupturable portion. In this manner, a packaging container is formed.

However, in such a packaging container, since two flaps are welded to the upper end-surface portion, it is difficult to secure a sufficiently large area where the spout open/close member is bonded. Therefore, the bonding area between the spout open/close member and the upper end-surface portion decreases, resulting in failure to bond the spout open/close member with sufficient adhesion force. In addition, since projections and depressions are formed on the upper end-surface portion, the appearance of the packaging container deteriorates. Moreover, if the spout open/close member is bonded to a narrow area, the spout open/close member becomes difficult to operate, with the result that the packaging container cannot be opened with ease.

A large-sized spout open/close member that covers the entire upper end-surface portion may be used. However, in this case, the degree of freedom in designing the size, shape, etc., of the spout open/close member decreases.

An object of the present invention is to solve the problems involved in conventional packaging containers and to provide a packaging container and packaging material therefor which can secure a sufficient area for bonding a spout open/close member, which enable the spout open/close member to be bonded with sufficient adhesion force, which i provide an improved appearance, and which increase the degree of freedom in designing the spout open/close member.

DISCLOSURE OF THE INVENTION

To achieve the above object, a packaging container according to the present invention comprises: a pair of seal portions; at least five side-surface panel portions for forming a circumferential wall; an end-surface panel portion disposed between the seal portion and the side-surface panel portions and adapted to form a polygonal end-surface portion in cooperation with an intermediate portion of the seal portion; and flap portions projected, together with end portions of the seal portion, from the end-surface panel portion, each of the flap portions being bent toward a specified panel portion among the side-surface panel portions and-being welded to the specified panel portion.

In this case, since the flap portions are welded to the specified panel portions, and the end-surface portion is thus made substantially flat, a sufficiently large flat area can be secured on the end-surface portion. Since no projection or depression is formed on the end-surface portion, the appearance of the packaging container can be improved, and a sufficiently large area for bonding the spout open/close member can be secured.

Further, the bonding area between the spout open/close member and the end-surface portion can be increased without use of a large spout open/close member that covers the entire end-surface portion, so that the spout open/close member can be bonded with sufficient adhesion force. Moreover, since the end-surface portion is not prone to accumulation of dust, the packaging container is sanitary. In addition, the appearance of the packaging container can be improved, and the degree of freedom in designing the size, shape, etc., of the spout open/close member can be increased.

Another packaging container according to the present invention further comprises a first folding portion formed between each of the flap portions and corresponding one of the specified panel portions, and a second folding portion formed between the end-surface panel portion and each side-surface panel portion adjacent to each of the specified panel portions.

In still another packaging container according to the present invention, each of the first and second folding portions has a lower folding portion formed adjacent to the side-surface panel portion and being superposed on the side-surface panel portion, as well as an upper folding portion formed adjacent to the lower folding portion and being superposed on the lower folding portion.

In still another packaging container according to the present invention, the upper folding portion and the lower folding portion of the first folding portion each have a rectangular shape, and the upper folding portion and the lower folding portion of the second folding portion each have a triangular shape.

In still another packaging container according to the present invention, crush portions are formed in regions surrounded by the flap portions, the upper folding portions of the first folding portions, and the upper folding portions of the second folding portions, and the crush portions are crushed when the flap portions are bent toward the specified panel portions.

In this case, since the crush portions are crushed when the flap portions are bent toward the specified panel portions, the upper end portions of the flap portions do not project far from the side-surface panel portions. Accordingly, the appearance of the packaging container can be improved.

A packaging material for a packaging container according to the present invention comprises: a pair of seal portions; at least five side-surface panel portions for forming a circumferential wall; an end-surface panel portion disposed between the seal portion and the side-surface panel portions and adapted to form a polygonal end-surface portion in cooperation with an intermediate portion of the seal portion; and flap portions projected, together with end portions of the seal portion, from the end-surface panel portion, each of the flap portions being bent toward a specified panel portion among the side-surface panel portions and being welded to the specified panel portion.

Another packaging material for a packaging container according to the present invention further comprises a first folding portion formed between each of the flap portions and corresponding one of the specified panel portions, and a second folding portion formed between the end-surface panel portion and each side-surface panel portion adjacent to each of the specified panel portions.

In still another packaging material for a packaging container according to the present invention, each of the first and second folding portions has a lower folding portion formed adjacent to the side-surface panel portion and being superposed on the side-surface panel portion, as well as an upper folding portion formed adjacent to the lower folding portion and being superposed on the lower folding portion.

In still another packaging material for a packaging container according to the present invention, the upper folding portion and the lower folding portion of the first folding portion each have a rectangular shape, and the upper folding portion and the lower folding portion of the second folding portion each have a triangular shape.

In still another packaging material for a packaging container according to the present invention, crush portions are formed in regions surrounded by the flap portions, the upper folding portions of the first folding portions, and the upper folding portions of the second folding portions, and the crush portions are crushed when the flap portions are bent toward the specified panel portions.

BEST MODE FOR CARRYING OUT THE INVENTION

An embodiment of the present invention will next be described in detail with reference to the drawings.

Figure 1:
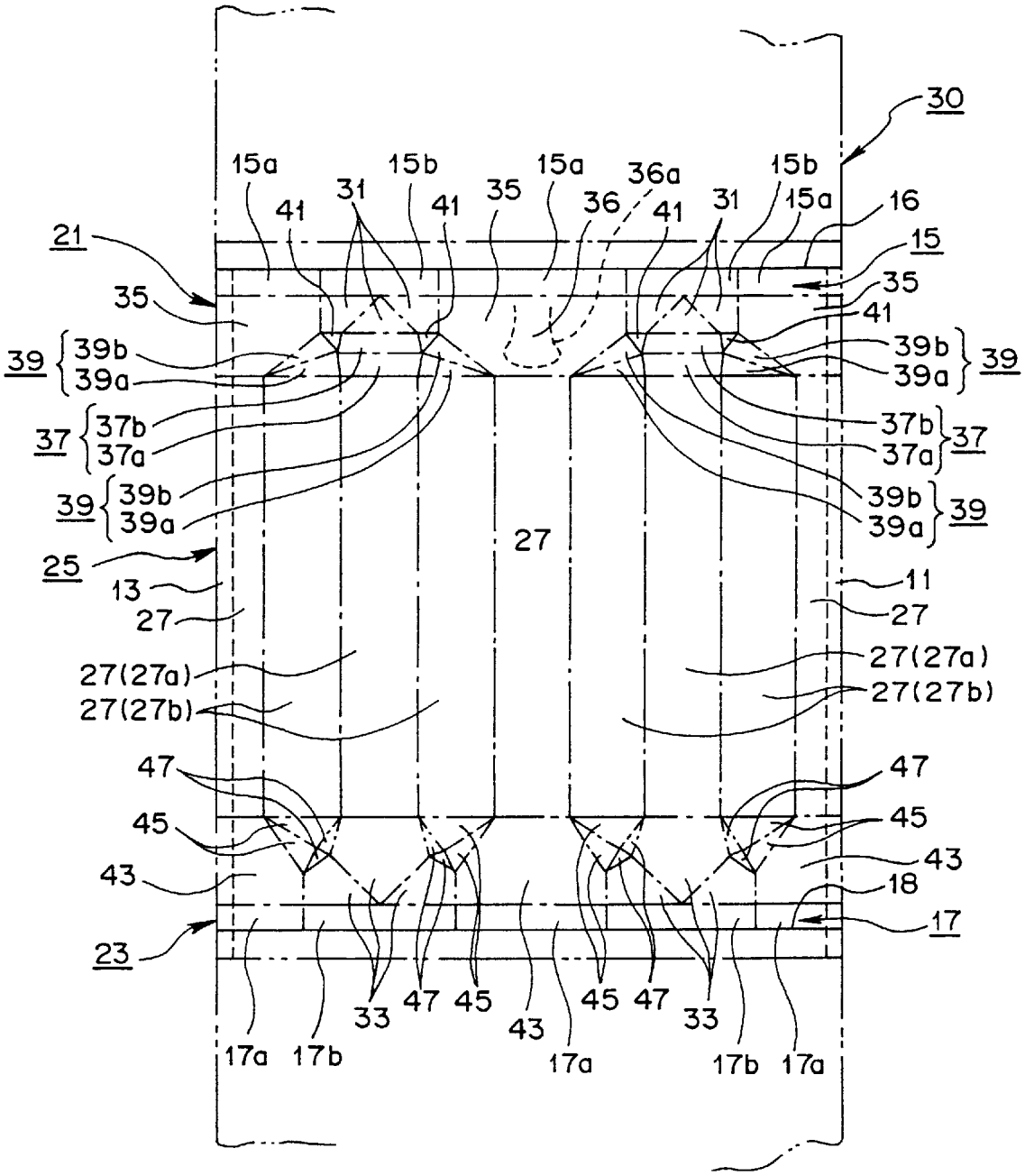
FIG. 1 is a development of a packaging material used in an embodiment of the present invention.
Figure 2:
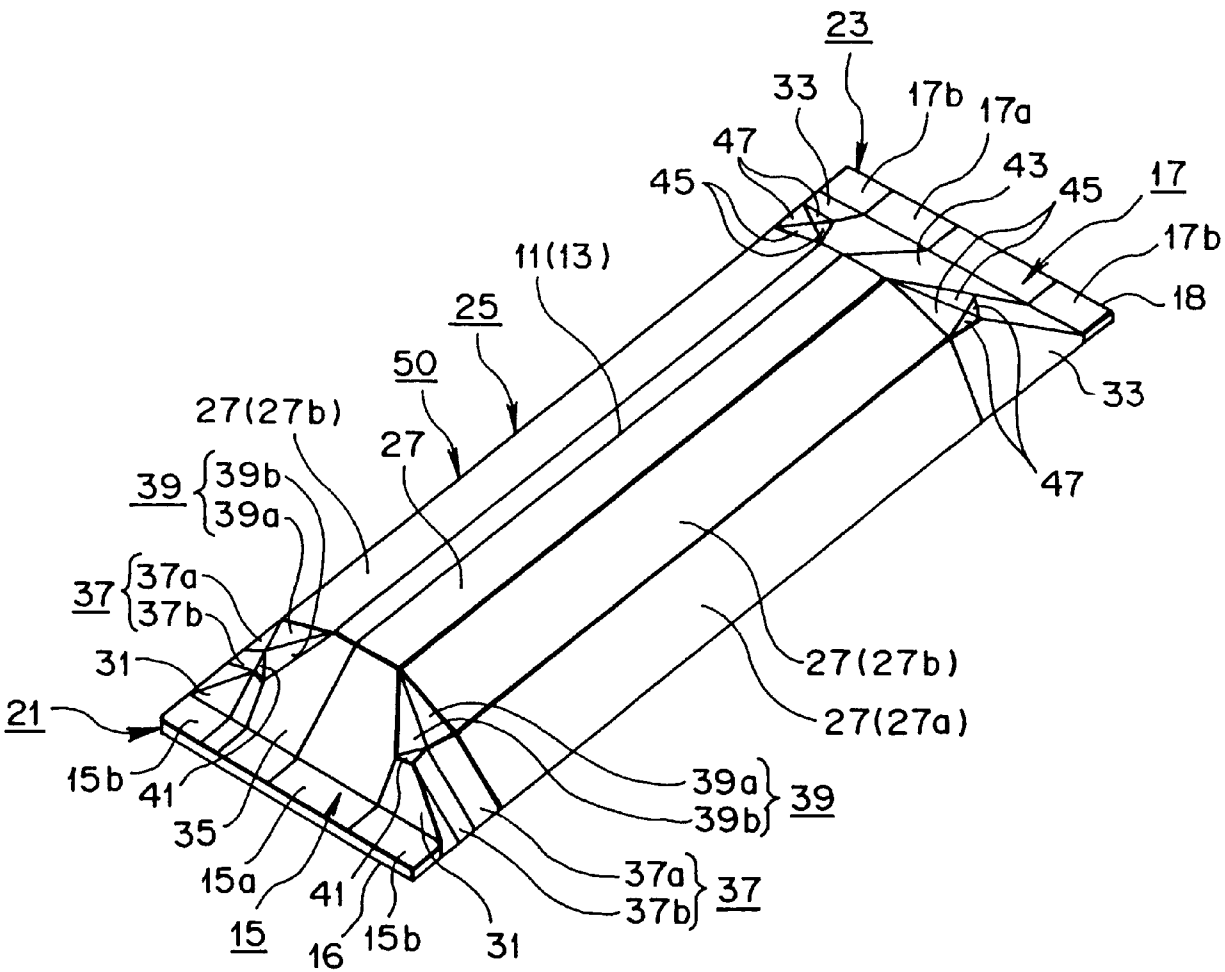
FIG. 2 is a perspective view of a semi-finished package in the embodiment of the present invention.
Figure 3:
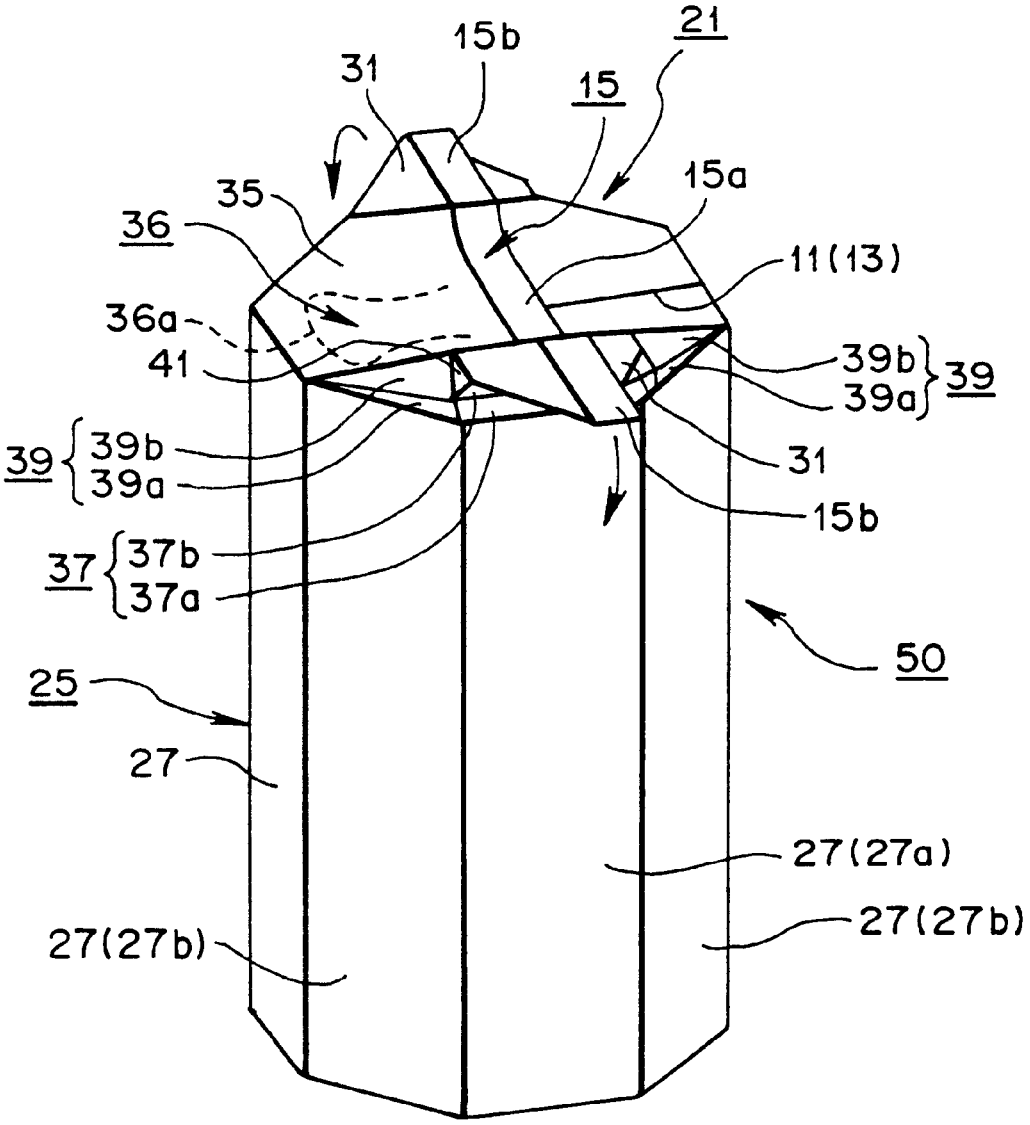
FIG. 3 is a first view showing a method of forming a final package in the embodiment of the present invention.
Figure 4:
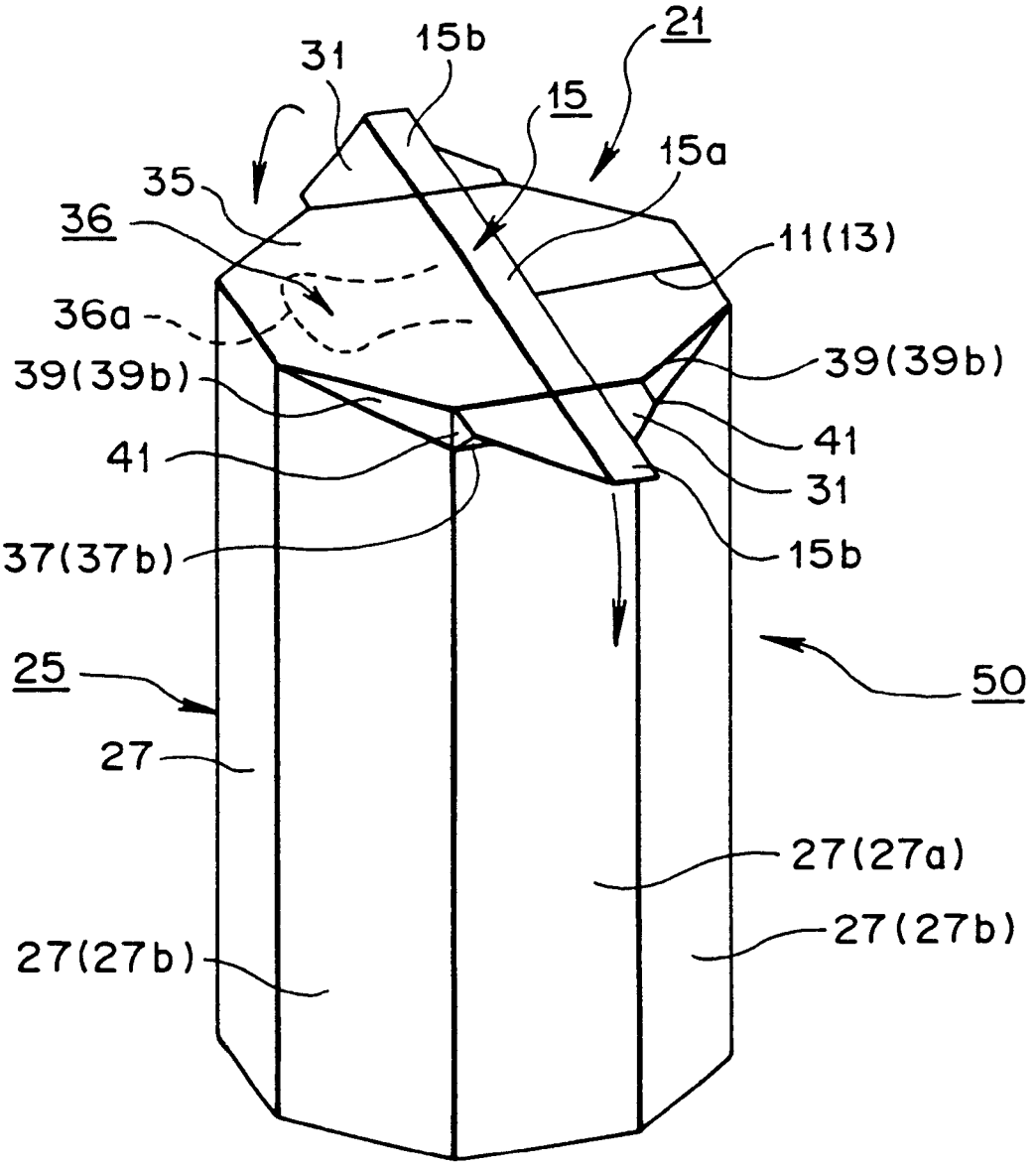
FIG. 4 is a second view showing the method of forming the final package in the embodiment of the present invention.
Figure 5:
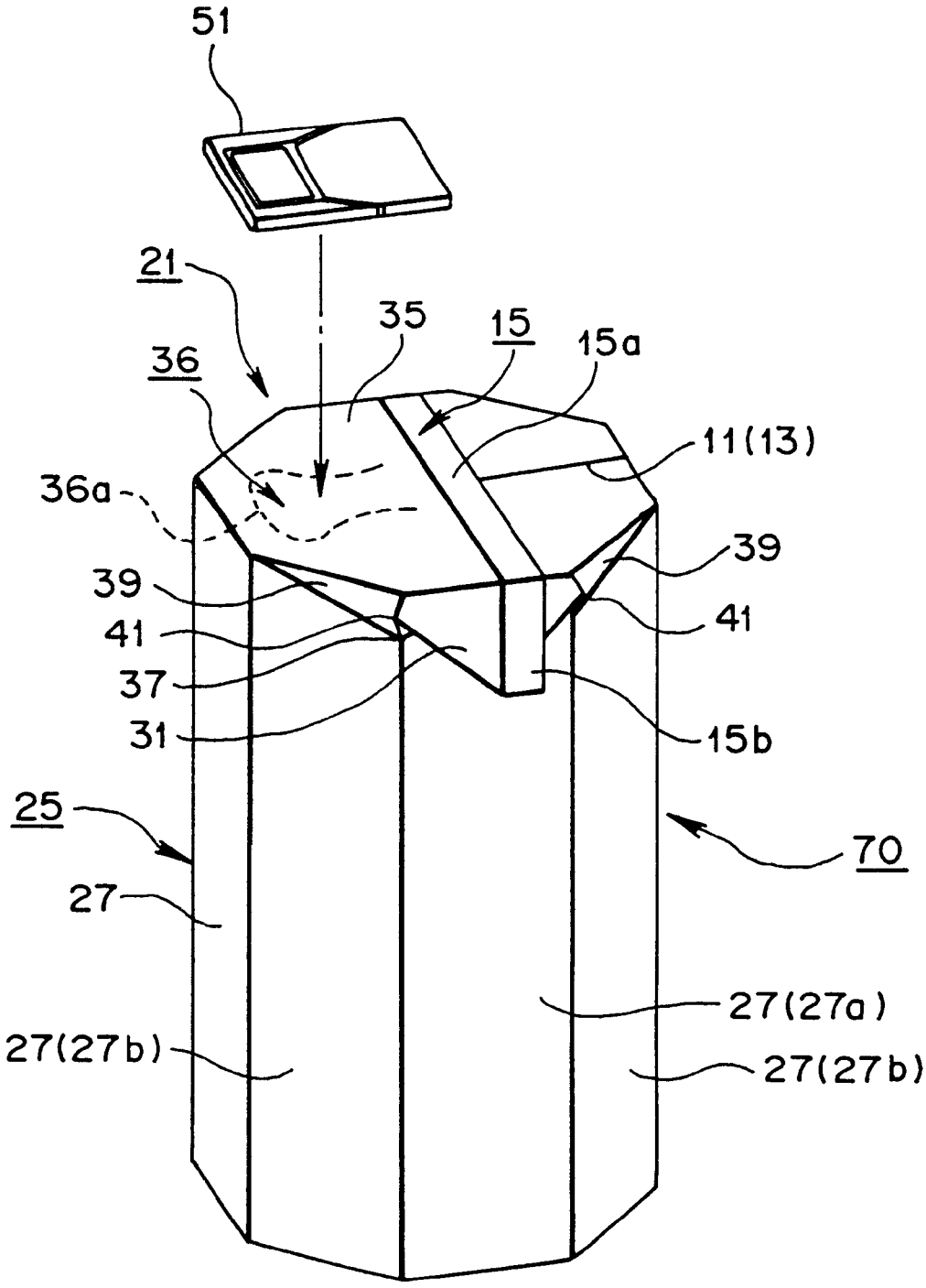
FIG. 5 is a view showing a state in which a spout open/close member is attached to the final package in the embodiment of the present invention.
Figure 6:
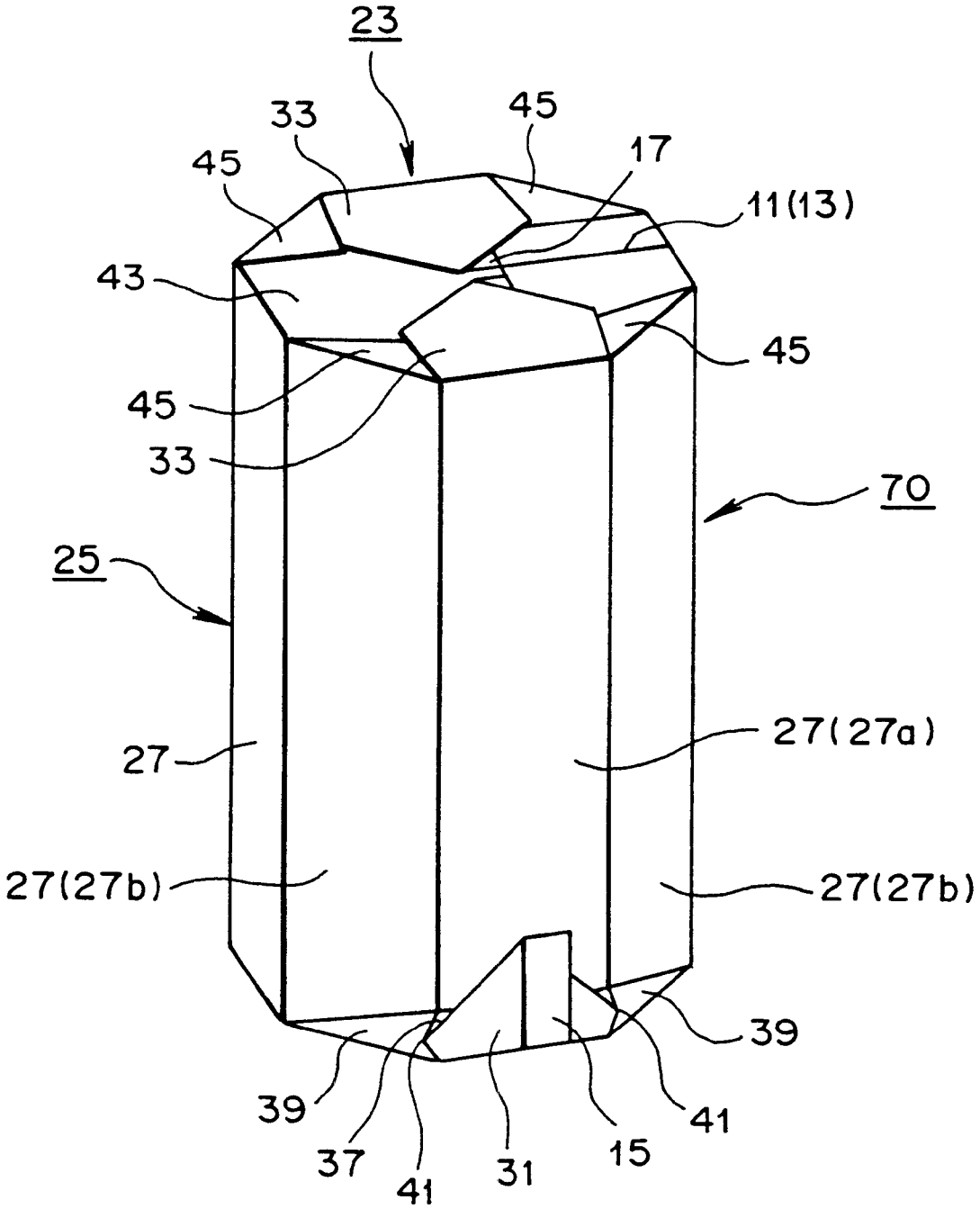
FIG. 6 is a perspective view of the final package in the embodiment of the present invention as viewed from the bottom thereof.

FIG. 1 is a development of a packaging material used in the embodiment of the present invention; FIG. 2 is a perspective view of a semi-finished package in the embodiment of the present invention; FIG. 3 is a first view showing a method of forming a final package in the embodiment of the present invention; FIG. 4 is a second view showing the method of forming the final package in the embodiment of the present invention; FIG. 5 is a view showing a state in which a spout open/close member is attached to the final package in the embodiment of the present invention; and FIG. 6 is a perspective view of the final package in the embodiment of the present invention as viewed from the bottom thereof.

A packaging material 30 is formed by a method in which a resin is applied or layered onto the surface of an unillustrated paper substrate. In a developed state, a region for forming one packaging container is defined between upper and lower cutting lines 16 and 18, which are formed to extend transversely. The region is divided by means of creases (shown by chain lines in FIG. 1) so as to form transverse seal portions 15 and 17, end-surface panel portions 35 and 43, flap portions 31 and 33 first and second folding portions 37 and 39, crush portions 41, primary bending portions 45, secondary bending portions 47, and side-surface panel portions 27.

Next, a method of manufacturing a packaging container will be described.

The method of manufacturing a packaging container comprises a first step of forming a semi-finished package (an intermediate product) 50 shown in FIG. 2 from the sheet-shaped packaging material 30 shown in FIG. 1; and a second step of forming a final package 70 shown in FIG. 5 from the semi-finished package 50 shown in FIG. 2.

In the first step, the packaging material 30 in a rolled state is unwound into a form of web. Longitudinal seal portions 11 and 13 formed at opposite transverse edges of the web-shaped packaging material 30 are superposed on each other and sealed together in a longitudinal direction, so that the packaging material 30 is formed into a tubular shape. Subsequently, liquid food is charged into the tubular packaging material 30, and the tubular packaging material 30 is sealed at strip-shaped transverse seal portions 15 and 17 provided at predetermined intervals.

The packaging material 30 has previously-defined regions for production of packaging containers. The transverse seal portion 15 is located at the upper end of each region and the transverse seal portion 17 is located at the lower end of each region. Cutting lines 16 and 18 are defined at positions between the upper-end transverse seal portion 15 of each region and the lower-end transverse seal portion 17 of the adjacent region.

Subsequently, the tubular packaging material 30 is cut along the cutting lines 16 and 18, so that a pillow-shaped, semi-finished package 50 is formed.

In the second step, the semi-finished package 50 is formed into, for example, an octagonal prism, so that the semi-finished package 50 has an octagonal cross section. At this time, two flap portions 31 formed at one end of the semi-finished package 50, which corresponds to the upper end of a packaging container, and two flap portions 33 formed at the opposite end of the semi-finished package 50, which corresponds to the lower end of the packaging container, are forced to project outward. Subsequently, as shown in FIG. 5, the flap portions 31 are bent outward and welded to the corresponding side-surface panel portions 27, and as shown in FIG. 6, the flap portions 33 are bent inward and welded to the bottom end surface. Thus, the final package 70 is formed. The details of the second step will be described later.

Next, the structure of the packaging container will be described.

In the packaging material 30, the semi-finished package 50, and the final package 70, there are defined an upper end-surface region 21, a lower end-surface region 23, and a side surface region 25. The side surface region 25 has eight rectangular side-surface panel portions 27 that are to form respective side surfaces of the packaging container.

The end-surface region 21 is composed of an end-surface panel portion 35, two flap portions 31, two first folding portions 37, four second folding portions 39, and four crush portions 41.

In the final package 70, the end-surface panel portion 35, together with an intermediate portion 15*a* of the transverse seal portion 15, forms an upper end-surface portion having an octagonal shape. A perforation 36*a* is formed in the upper end-surface portion in order to define a rupturable portion 36 at a position other than those of the longitudinal seal portions 11 and 13 and the transverse seal portion 15. The rupturable portion 36 enable easy opening of the packaging container.

When the semi-finished package 50 is formed into an octagonal prism, each flap portion 31, together with an end portion 15*b* of the transverse seal portion 15, is projected from the end-surface panel portion 35 (a side of the side-surface panel portion 27), and assumes a substantially triangular shape. Each flap portion 31 is located adjacent to each of two opposed specified panel portions 27*a* among the side-surface panel portions 27 as well as to the end-surface panel portion 35. The flap portions 31 are bent toward the specified panel portions 27*a* and are welded thereto.

Each of the first folding portions 37 is formed between the corresponding flap portion 31 and the. specified panel portion 27*a*, and each of the second folding portions 39 is formed between the end-surface panel portion 35 and each side-surface panel portion 27*b* adjacent to the specified panel portions 27*a*. Each of the first folding portions 37 has a lower folding portion 37*a* that is superposed on the specified panel portion 27*a*, as well as an upper folding portion 37*b* that is superposed on the lower folding portion 37*a*. Each of the first folding portions 39 has a lower folding portion 39*a* that is superposed on the side-surface panel portion 27*b*, as well as an upper folding portion 39*b* that is superposed on the lower folding portion 39*a*. The lower folding portion 37*a* and the upper folding portion 37*b* of each first folding portion 37 each have a rectangular shape, and the lower folding portion 39*a* and the upper folding portion 39*b* of each second folding portion 39 each have a triangular shape. Therefore, when the flap portions 31 are bent toward the specified panel portions 27*a* through folding of the first and second folding portions 37 and 39, the end-surface panel portion 35 becomes substantially flat. The crush portions 41 are formed in regions surrounded by the flap portions 31, the first folding portions 37, and the second folding portions 39 and each have a triangular shape.

Meanwhile, the lower end-surface region 23 is composed of the end-surface panel portion 43, two flap portions 33, and primary bending portions 45 and secondary bending portions 47 formed on opposite sides of each of the flap portions 33.

In the final package 70 shown in FIG. 6, the end-surface panel portion 43, together with an intermediate portion 17*a* of the transverse seal portion 17, forms a lower end-surface portion having an octagonal shape.

When the semi-finished package 50 is formed into an octagonal prism, each flap portion 33, together with an end portion 17*b* of the transverse seal portion 17, is projected from the end-surface panel portion 43 (a side of the side-surface panel portion 27), and assumes a substantially pentagonal shape. Each flap portion 33 is located adjacent to one of the specified panel portions 27*a* as well as to the lower end-surface portion. The flap portions 33 are bent toward the lower end-surface portion and are welded thereto.

The above-described primary and secondary bending portions 45 and 47 are formed in regions surrounded by the end-surface panel portion 43, the flap portions 33, and the side-surface panel portions 27*b*.

Next, the second step will be described in detail.

Figure 7:
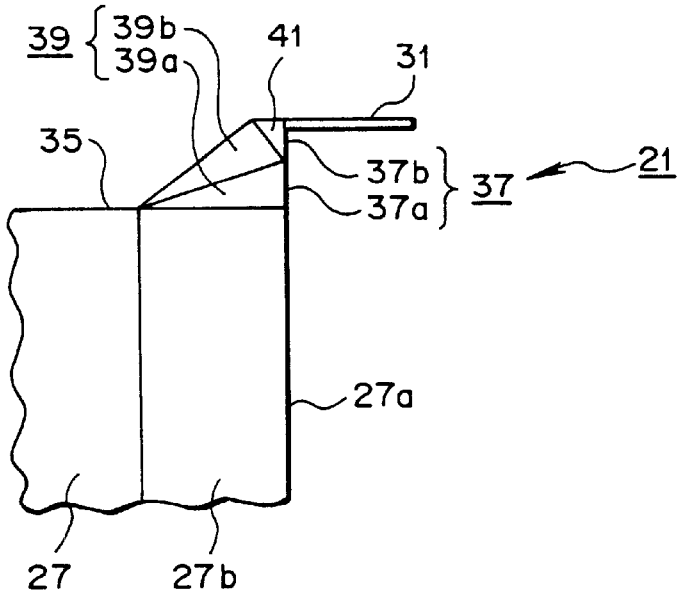
FIG. 7 is a first view of a main portion of the final package showing the manner of forming the final package in the embodiment of the present invention.
Figure 8:
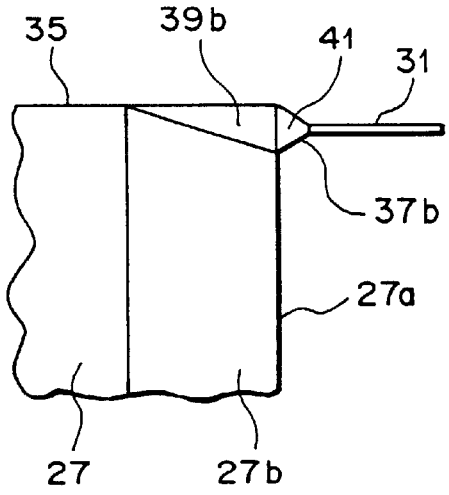
FIG. 8 is a second view of the main portion of the final package showing the manner of forming the final package in the embodiment of the present invention.

FIG. 7 is a first view of a main portion of the final package showing the manner of forming the final package in the embodiment of the present invention; FIG. 8 is a second view of the main portion of the final package showing the manner of forming the final package in the embodiment of the present invention; and FIG. 9 is a third view of the main portion of the final package showing the manner of forming the final package in the embodiment of the present invention.

As described above, in the second step, the semi-finished package 50 is formed into an octagonal prism such that the semi-finished package 50 has an octagonal cross section. At this time, the flap portions 31 and 33 are projected.

In the upper end-surface region 21, after the flap portions 31 are projected outward as shown-in FIG. 7, the lower folding portions 37*a* and 39*a* of the first and second folding portions 37 and 39 are folded onto the specified panel portions 27*a* and the side-surface panel portions 27*b*, respectively, so that, as shown in FIG. 8, the lower folding portions 37*a* and 39*a* are covered by the upper folding portions 37*b* and 39*b*, respectively. Therefore, the upper end-surface portion becomes substantially flat.

Figure 9:
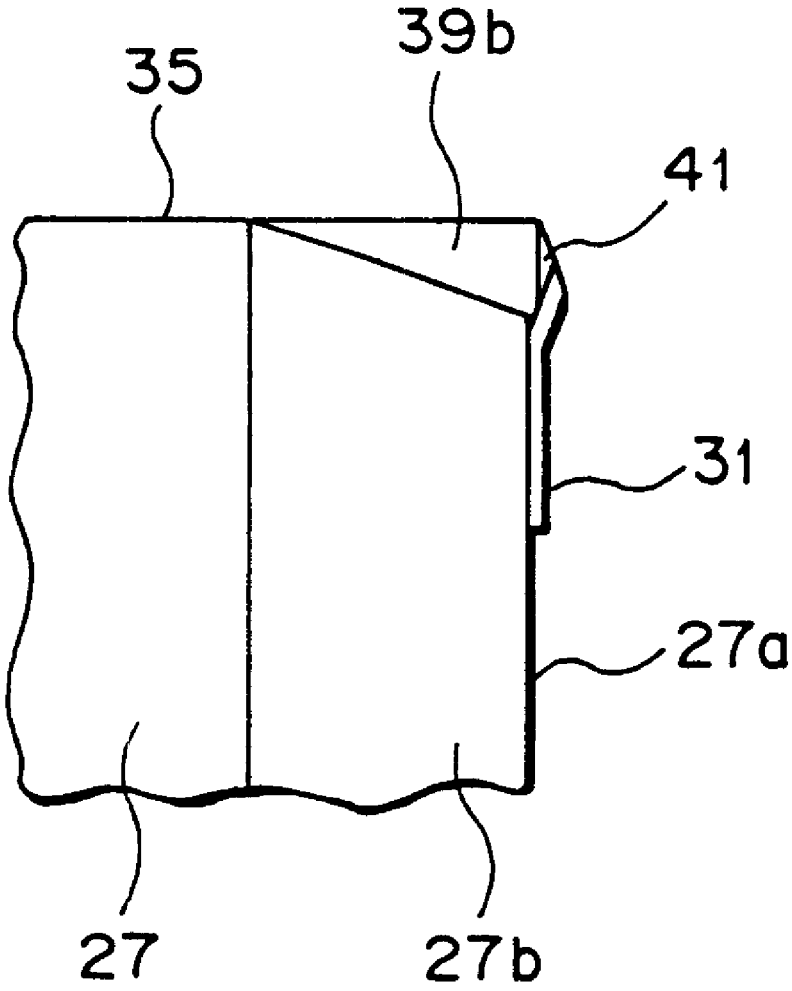
FIG. 9 is a third view of the main portion of the final package showing the manner of forming the final package in the embodiment of the present invention.

Subsequently, as shown in FIG. 9, the flap portions 31 are bent toward the specified panel portions 27*a*, and resin at the surface of the flap portions 31 and resin at the surface of the specified panel portions 27*a* are heated at a contact portion therebetween, so that the flap portions 31 are welded to the specified panel portions 27*a*.

At this time, since crush portions 41 are crushed, the upper end portions (base end portions) of the flap portions 31 do not project far from the specified panel portions 27*a*. Subsequently, a spout open/close member 51 formed of resin is bonded to the above-described rupturable portion 36 (FIG. 5).

Meanwhile, in the lower end-surface region 23, as shown in FIG. 6, the primary bending portions 45 and the secondary bending portions 47 (FIG. 1) are folded, and the flap portions 33 are bent toward the lower end-surface portion. Subsequently, resin at the surface of the flap portions 33 and resin at the surface of the lower end-surface portion are heated at a contact portion therebetween, so that the flap portions 33 are welded to the lower end-surface portion.

As described above, in the upper end-surface region 21, the flap portions 31 are welded to the specified panel portions 27*a*, and the first and second folding portions 37 and 39 are folded to make the upper end-surface portion substantially flat, so that a sufficiently large flat area can be secured on the upper end-surface portion. Since no projection or depression is formed on the upper end-surface portion, the appearance of the packaging container can be improved, and a sufficiently large area for bonding the spout open/close member 51 can be secured.

Further, the bonding area between the spout open/close member 51 and the upper end-surface portion can be increased without use of a large spout open/close member that covers the entire upper end-surface portion, so that the spout open/close member 51 can be bonded with sufficient adhesion force. Moreover, since the upper end-surface portion is not prone to accumulation of dust, the packaging container is sanitary. In addition, the appearance of the packaging container can be improved, and the degree of freedom in designing the size, shape, etc., of the spout open/close member 51 can be increased.

Since the crush portions 41 are crushed when the flap portions 31 are bent toward the specified panel portions 27*a*, the upper end portions of the flap portions 31 do not project far from the specified panel portions 27*a*. Accordingly, the appearance of the packaging container can be improved.

Although in the embodiment only the upper end-surface portion of the packaging container is made flat, the lower end-surface portion may also be made flat.

Further, although in the embodiment a packaging container having an octagonal shape is described, the present invention is applicable to packaging containers having the shape of a pentagonal prism or a higher-order polygonal prism.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention is applicable to a packaging container manufacturing apparatus for manufacturing packaging containers.

What is claimed is:

1. A packaging container comprising:

(a) a pair of seal portions;

(b) a plurality of rectangular side-surface panel portions of the same size and forming a tube having a circumferential wall right polygonal in cross-section:

(c) a pair of end-surface panel portions disposed between one of said seal portions and said side-surface panel portions and forming a right polygonal end-surface portion, in cooperation with an intermediate portion of said one seal portion, closing one end of said tube, one of said end-surface portions having a weakened rupturable portion;

(d) flap portions projecting, together with an end portion of said one seal portion, from said end-surface panel portions, each of said flap portions being bent onto one of said side-surface panel portions and being welded to said one side-surface panel portion; and (e) a pair of folding portions respectively connecting each one of said flap portions to two of said side-surface panel portions contiguous with a third side-surface panel portion therebetween.

2. A packaging container according to claim 1, further comprising:

a second pair of end-surface panel portions disposed between a second of said seal portions and said side-surface panel portions and forming a polygonal end-surface portion, in cooperation with an intermediate portion of said second seal portion, closing a second end of said tube.

3. A packaging container according to claim 1, wherein each of said folding portions has upper and lower folding portions, said upper folding portion being superposed on said lower folding portion.

4. A packaging container according to claim 3, wherein (a) the-upper folding portion and the lower folding portion of said first folding portion each have a rectangular shape; and (b) the upper folding portion and the lower folding portion of said second folding portion each have a triangular shape.

5. A packaging container according to claim 3, further comprising:

crushed portions formed in regions surrounded by said flap portions, the upper folding portions of said first folding portions, and the upper folding portions of said second folding portions.

6. A packaging container according to claim 1 wherein each one of said flap portions is connected to said third side-surface panel portion through a third folding portion.

7. A packaging material for forming a packaging container comprising:

(a) a pair of seal portions;

(b) a plurality of rectangular side-surface panel portions of the same size and joined directly to each other in series for forming a circumferential wall of a tube;

(c) a pair of end-surface panel portions disposed between one of said seal portions and said side-surface panel portions and adapted to form a right polygonal end-surface portion, in cooperation with an intermediate portion of said one, seal portion, to close one end of the tube, one of said end-surface portions having a weakened rupturable portion;

(d) flap portions foldable, together with an end portion of said seal portion, to project from said end-surface panel portions, each of said flap portions being positioned adjacent to said end-surface panel portions for bending onto one of said side-surface panel portions, for welding to said one side-surface panel portion; and (e) a pair of folding portions respectively connecting each one of said flap portions to two of sad side-surface panel portions contiguous with a third side-surface panel portion therebetween.

8. A packaging material for a packaging container according to claim 6, wherein each of said folding portions has upper and lower folding portions, said upper folding portion being foldable onto said lower folding portion.

9. A packaging material for a packaging container according to claim 8, wherein (a) the upper folding portion and the lower folding portion of said first folding portion each have a rectangular shape; and (b) the upper folding portion and the lower folding portion of said second folding portion each have a triangular shape.

10. A packaging material for a packaging container according to claim 8, further comprising:

crushable portions in regions surrounded by said flap portions, the upper folding portions of said first folding portions, and the upper folding portions of said second folding portions, said crushable portions being crushed when said flap portions are bent toward said one side-surface panel portion.

11. A packaging container according to claim 7 wherein each one of said flap portions is connected to said third side-surface panel portion through a third folding portion.

12. A packaging material for forming a container according to claim 7, further comprising:

a second pair of end-surface panel portions disposed between a second of said seal portions and said side-surface panel portions and adapted to form a polygonal end-surface portion in cooperation with an intermediate portion of said second seal portion to close a second end of the tube.

* * * * *